United States Patent [19]

Takahashi et al.

[11] 4,368,172

[45] Jan. 11, 1983

[54] HEAT RESISTANT CAST ALLOY

[75] Inventors: Makoto Takahashi; Junichi Sugitani, both of Hirakata, Japan

[73] Assignee: Kubota, Ltd., Osaka, Japan

[21] Appl. No.: 154,450

[22] Filed: May 29, 1980

[30] Foreign Application Priority Data

May 31, 1979 [JP] Japan ..... 54-68385

[51] Int. Cl.[3] ..... C22C 30/00

[52] U.S. Cl. ..... 420/584

[58] Field of Search ..... 75/122, 134 F, 171

[56] References Cited

U.S. PATENT DOCUMENTS 3,127,265 3/1964 Avery ..... 75/171

*Primary Examiner*—R. Dean

*Attorney, Agent, or Firm*—Oblon, Fisher, Spivak, McClelland & Maier

[57] ABSTRACT

A heat resistant cast alloy for uses in as high a temperature range as around 1,100° C., having high resistances to oxidation and cementation and high creep-rupture strength, which alloy consists of following components, as represented on weight basis: C, 0.35~0.6%; Si, 1.58~2.5%; Mn, 0.3~0.9%; Cr, 24~28%; Ni, 30~38%; W, 2~6%; N, 0.07~0.3%; P<0.04% and S<0.04%; and balance, substantially Fe.

4 Claims, No Drawings

HEAT RESISTANT CAST ALLOY

BACKGROUND OF THE INVENTION

The present invention relates to providing a heat resistant cast alloy having high creep-rupture strength and high resistance to cementation, adapted for use at as high a temperature range as around 1,100° C.

As well known, prior-art materials of heat resistant cast alloy include HK40 (0.4% C, 25% Cr and 20% Ni, balance Fe) and HP40 (0.4% C, 25% Cr and 35% Ni, balance Fe), which have been utilized as heat resistant materials of apparatuses in petrochemical industries. Especially, the alloy HK40 prides itself in its years achievements in use as reformer tubes for use under 1,000° C. If it is used as cracking furnace tubes which are heated above 1,000° C., however, it undergoes deterioration in the creep-rupture strength accompanying the coarse-growing of carbides, and with notable sign of cementation. Such tubes required early relacement. These drawbacks found to be further worsened, as the operating temperature approaches around 1,100° C., have left as intractable problems.

At such high temperatures as around 1,000° C., the C deposited on the inside surface of the tube during the cracking of naphtha readily diffuses into the inside surface, causing cementation, and observed in addition thereto are primary carbides spheroidizing and the deposited secondary carbides undergoing early growth, resulting in deterioration in the creep-rupture strength.

On the other hand, the alloy HP40, although stabler than the aforementioned alloy HK40 in the operating temperature range around 1,100° C., in fact, can hardly deal with the deterioration in the resistance to cementation and that in the creep-rupture strength under such circumstances as above described.

A BRIEF SUMMARY OF THE INVENTION

An object of this invention is to provide a heat resistant alloy consisting of 0.35~0.6% C, 1.58~2.5% Si, 0.3~0.9% Mn, 24~28% Cr, 30~38% Ni, 2~6% W, 0.07~0.03% N, P<0.04%, S<0.04%, balance substantially Fe, thereby solving the problems in conventional alloys abovementioned.

DETAILED DESCRIPTION OF THE INVENTION

In the following, the present invention is described in detail, giving the limiting factors for the components of the alloy.

C: 0.35~0.6%

C is an element effective for improving the creep-rupture strength of austenitic alloys of this type. Thus, with increasing amounts of C, the creep-rupture life is lengthened. For the use of this alloy at temperatures above 1,000° C., at least 0.35% C is needed in order to achieve high creep-rupture strength. With higher than 0.6% C, however, the creep-rupture strength conversely tends to go down, and the deposition of the secondaty carbides increases, resulting in embrittlement of the alloy for more adverse effects thereon from thermal shock or thermal fatigue. On this ground, the preferable range was determined to be 0.35~0.6%.

Si: 1.58~2.5%

Si is an element not only having the deoxidizing effect in steel making, but being effective for improving the resistance to cementation of the alloy while it is in service. Thus, it forms Fe-Si-based oxides on the steel surface, providing the effect for preventing the diffusion of C. This effect will be little exhibited at such high temperatures as above 1,000° C., if the amount of Si is less than 1.58%. At least 1.58% is necessary for its addition to be effective. On the other hand, reduction in the creep-rupture strength results, if its amount is larger than 2.5%.

Accordingly, the limitation was set in the range of 1.58~2.5%.

Mn: 0.3~0.9%

Mn, being a deoxidizer, and added as an element for fixing S, needs to be used in an amount of at least 0.3% in order to exhibit this effect. If the amount of use is in excess of 0.9%, it causes degradation of the alloy in its resistance to oxidation and creep-rupture strength under such a harsh circumstance or at as high a temperature as about 1,100° C.

Accordingly, the limitation of 0.3~0.9% was set.

Cr: 24~28%

Cr is an element effective for obtaining adequate resistance to oxidation and high strength at high temperatures. But if the use of this alloy at as high temperatures as about 1,100° C. is contemplated, sufficient resistance to oxidation can not be achieved with less than 24% Cr. The amount of Cr over 28% will invite lowered toughness. These factors set the limitation in the range of 24~28%.

Ni: 30~38%

Ni is an element effective for stabilizing austenite, and improving the resistances to oxidation and cementation of the alloy and its strength at high temperatures. But at such high ambient temperatures as about 1,100° C. while in service of the alloy, its resistances to oxidation and cementation are not enough, if it has less than only 30% Ni content. On the other hand, if the Ni content is more than 38%, its addition is barely effective, showing a small degree of improvement in the aforementioned effects.

Accordingly, the limitation was settled in the range of 30~38%.

W: 2~6%

W is an element effective for increasing the strength of the alloy at high temperatures. If its content is less than 2%, the increase in the creep-rupture strength is small, and it is only when W is used in amounts more than 2% that notable gain in this strength becomes evident. Even if the use of this alloy at a maximum temperature, e.g., about 1,150° C. is contemplated, there is no need of its usage above 6%. Moreover, with W used in amounts in excess of 6% hardening of the material itself and the accompanying reduction in its ductility in low temperature range are observed. These were the factors contributed to setting the limitation in the range of 2~6%.

N: 0.07~0.3%

N, being an element effective for elevating the strength at high temperatures, lends itself effectively to strengthening the granules of austenite. Less than 0.05% of N may be introduced by the normal atmospheric solubilization, but it is only with its addition of at least 0.07% that any recognizable increase in the creep-rupture strength becomes apparent. With increasing amounts of N, the aforementioned strength is improved. With its addition of more than 0.3%, however, the yield in the usual solubilizing operation markedly drops, detracting from economy. These were the contributing factors whereby the limitation was set in the range of 0.07~0.3%.

P, S: <0.04%

Both P and S are contained as impurities. If they are contained in excess of 0.04%, they have adverse effect on the weldability of the alloy. It was for this reason that their permissible contents were limited to below 0.04%.

In the following, the excellent performance of this alloy is revealed in connection with a few embodiments of this invention.

Table 1 below lists chemical compositions of the alloys of embodiments of this invention and those of contrasted alloys; and Table 2 gives the results of the test of the resistance to oxidation, the results of the test of the resistance to cementation and the results of the test of the creep-rupture strength.

In preparing a test sample, 35 kg of the material was melted in a high frequency induction furnace, and the molten metal was cast in a centrifugal caster into a shape having 135 mm O.D., 25 mm thick and 520 mm long, from which the test pieces for respective tests were taken.

TABLE 1

| | Chemical Compositions | | | | | | | | |
|---|---|---|---|---|---|---|---|---|---|
| | Chemical compositions (% by weight) | | | | | | | | |
| | C | Si | Mn | P | S | Cr | Ni | W | N |
| Contrasted alloy (1) HK40 | 0.42 | 1.22 | 1.05 | 0.012 | 0.006 | 25.3 | 19.8 | — | — |
| Contrasted alloy (2) HP40 | 0.40 | 1.05 | 1.06 | 0.014 | 0.009 | 25.0 | 34.7 | — | — |
| Contrasted alloy (3) | 0.45 | 0.81 | 0.74 | 0.013 | 0.010 | 25.5 | 34.7 | 4.73 | 0.126 |
| Contrasted alloy (4) | 0.44 | 2.76 | 0.77 | 0.013 | 0.008 | 25.2 | 35.1 | 4.66 | 0.109 |
| Contrasted alloy (5) | 0.44 | 1.55 | 1.89 | 0.015 | 0.007 | 25.5 | 35.0 | 4.70 | 0.132 |
| Contrasted alloy (6) | 0.43 | 1.64 | 0.68 | 0.014 | 0.010 | 22.8 | 34.3 | 4.55 | 0.130 |
| Contrasted alloy (7) | 0.48 | 1.63 | 0.65 | 0.014 | 0.008 | 24.7 | 27.6 | 5.03 | 0.154 |
| Contrasted alloy (8) | 0.49 | 1.58 | 0.66 | 0.014 | 0.009 | 25.6 | 36.0 | 1.36 | 0.114 |
| Contrasted alloy (9) | 0.49 | 1.54 | 0.72 | 0.013 | 0.007 | 25.6 | 35.2 | 4.72 | 0.033 |
| Alloy of an embodiment (1) | 0.52 | 1.58 | 0.66 | 0.017 | 0.011 | 26.1 | 34.5 | 2.59 | 0.233 |
| Alloy of an embodiment (2) | 0.47 | 1.63 | 0.74 | 0.012 | 0.008 | 25.7 | 34.8 | 5.52 | 0.090 |
| Alloy of an embodiment (3) | 0.50 | 1.67 | 0.65 | 0.014 | 0.009 | 26.4 | 34.8 | 4.29 | 0.167 |
| | | | | | | (Balance Fe) | | | |

TABLE 2

| | Tests Results | | |
|---|---|---|---|
| | Resistance to oxidation, at 1,150° C., for 300 hr, Loss from corrosion, mm/year | Resistance to cementation at 1,150° C., for 200 hr, Increased amount of C at the position at 1 mm from the inside surface (%) | Results of creep-rupture test, at 1,100° C., with 1.15 kg/mm$^2$ |
| Contrasted alloy (1) HK40 | 0.34 | 3.1% | 183.5 |
| Contrasted alloy (2) HP40 | 0.20 | 1.5 | 429.2 |
| Contrasted alloy (3) | 0.29 | 1.1 | 1316.9 |
| Contrasted alloy (4) | 0.18 | 0.2 | 751.6 |
| Contrasted alloy (5) | 0.28 | 0.5 | 788.0 |
| Contrasted alloy (6) | 0.29 | 0.7 | 915.3 |
| Contrasted alloy (7) | 0.27 | 1.0 | 1423.6 |
| Contrasted alloy (8) | 0.21 | 0.6 | 807.1 |
| Contrasted alloy (9) | 0.24 | 0.5 | 544.4 |
| Alloy of an embodiment (1) | 0.20 | 0.6 | 1648.5 |
| Alloy of an embodiment (2) | 0.24 | 0.5 | 1495.2 |
| Alloy of an embodiment (3) | 0.21 | 0.5 | 1587.0 |

The results of the test of the resistance to oxidation were obtained by conducting the test for 300 hours in an atmosphere held at 1,150° C. with 3 test pieces each in the shape of a round rod having 20 mm diameter and 50 mm long taken from the aforementioned test sample, and by caluculating depth of oxidation in a year from loss of weight determined by the test of oxidation.

In the cementation test, the test piece taken from the pipe material having 130 mm O.D., 110 mm I.D. and 120 mm long was subjected to cementation by packing a solid carburizing material in the inside of the test piece, and the chips sampled from the position at 1 mm from its inside surface were analyzed for C.

These results indicate that alloys showing degrading tendency in the resistance to oxidation are alloy HK40 of the contrasted material (1), the low Si content alloy of the contrasted material (3), the high Mn content alloy of the contrasted material (5), the low Cr content alloy of the contrasted material (6) and the low Ni content alloy of the contrasted material (7), and that in terms of the resistance to cementation, the alloy HK40 of the contrasted material (1) is the worst, and the alloy HP40 of the contrasted material (2) is appreciably susceptible to cementation.

Other contrasted materials more vulnerable to cementation than the materials of embodiments of this invention include the low Si content allow of the contraste material (3) and the low Ni content of the contrasted material (7), the others being not much different from the results obtained with the materials of the invention.

Where the creep-rupture service life is concerned, both The alloy HK40 of the contrasted material (1) and the alloy HP40 of the contrasted material (2) have very short service lives. Only other contrasted materials which gave results approaching those obtained with the materials of this invention are the contrasted materials (3) and (7); the high Si content alloy of the contrasted material (4), the high Mn content alloy of (5), the low Cr content alloy of (6), the low W content alloy of (8) and the low N content alloy of (9) all are much inferior to the materials of this invention.

The above-described discussion demonstrates that the materials (1), (2) and (3) of this invention are excellent in all counts examined—in the resistance to oxidation, resistance to cementation and in the creep-rupture strength.

The alloy of this invention has provided a solution to the problems with conventional materials, by placing limitations on its components, as described in the foregoing. It shows excellent performance in as high a temperature as around 1,100° C. in the resistances to oxidation and cementation and in the creep-rupture strength. Accordingly, this material is not only suitable as a cracking tube material exposed to the aforementioned temperature range, but is also adaptable for uses in environments involving temperatures above 1,000° C., where it is used as reformer tubes and tube supports for petrochemical industry or as hearth rolls and radiant tubes, etc., in steel making facilities.

What is claimed is:

1. A heat resistant cast alloy consisting of 0.35~0.6% C, 1.58~2.5% Si, 0.3~0.9% Mn, 24~28% Cr, 30~38% Ni, 2~6% W, 0.07~0.3% N, P<0.04% and S<0.04%, balance substantially Fe, as represented on the weight basis.

2. A heat resistant cast alloy according to claim 1 wherein: C, 0.52%; Si, 1.58%; Mn, 0.66%; Cr, 26.1%; Ni, 34.5%; W, 2.59%; and N, 0.233%, as represented on the weight basis.

3. A heat resistant cast alloy according to claim 1 wherein: C, 0.47%; Si, 1.63% Mn, 0.74%; Cr, 25.7%; Ni, 34.8%; W, 5.52%; and N, 0.090%, as represented on the weight basis.

4. A heat resistant cast alloy according to claim 1 wherein: C, 0.50%; Si, 1.67%; Mn, 0.65%; Cr, 26.4%; Ni, 34.8%; W, 4.29%; and N, 0.167%, as represented on the weight basis.

* * * * *